United States Patent [19]

Tanaka et al.

[11] 4,397,290

[45] Aug. 9, 1983

[54] SUPPLY-VOLTAGE-COMPENSATED CONTACTLESS IGNITION SYSTEM FOR INTERNAL COMBUSTION ENGINES

[75] Inventors: Toshio Tanaka, Anjo; Tomoatsu Makino, Okazaki, both of Japan

[73] Assignee: Nippondenso Co., Ltd., Kariya, Japan

[21] Appl. No.: 256,833

[22] Filed: Apr. 23, 1981

[30] Foreign Application Priority Data

May 23, 1980 [JP] Japan ..... 55-68602

[51] Int. Cl.[3] ..... F02P 3/04

[52] U.S. Cl. ..... 123/618; 123/609

[58] Field of Search ..... 123/618, 609, 617, 625

[56] References Cited

U.S. PATENT DOCUMENTS 3,841,288 10/1974 Korteling ..... 123/609
4,185,603 1/1980 Sohner et al. ..... 123/609
4,308,848 1/1982 Ptaff et al. ..... 123/618

FOREIGN PATENT DOCUMENTS 2925235 1/1981 Fed. Rep. of Germany ..... 123/609
55-32975 3/1980 Japan ..... 123/618

*Primary Examiner*—Charles J. Myhre
*Assistant Examiner*—Andrew M. Dolinar
*Attorney, Agent, or Firm*—Cushman, Darby & Cushman

[57] ABSTRACT

A supply-voltage-compensated contactless ignition system for internal combustion engines, which includes input transistor operable in response to an engine ignition signal so as to control the operation of a power transistor to control the energization of an ignition coil with the operating level of the input transistors being varied with variation in the supply voltage, further includes a current mirror circuit having first and second current shunt paths including first and second transistors which are connected in parallel with a voltage clamping device such that the each current path substantially the same amount of current when the supply voltage is normal and that one of the current paths shunts a current increased over that of the other in response to a rise of the supply voltage beyond a predetermined value, and includes a shunt device for shunting the increased current to the input transistors.

12 Claims, 5 Drawing Figures

SUPPLY-VOLTAGE-COMPENSATED CONTACTLESS IGNITION SYSTEM FOR INTERNAL COMBUSTION ENGINES

The present invention relates to contactless or full transistorized ignition systems for internal combustion engines, and more particularly the invention relates to an improved contactless ignition system in which the operating level of a waveform reshaping circuit is varied to vary the "on" period of current flow to an ignition coil to a more optimum value in accordance with variation in the supply voltage.

With a known type of contactless ignition system in which the "on" period of primary current flow through the ignition coil is varied in accordance with the speed of an internal combustion engine, there are disadvantages of causing an ignition energy deficiency upon decreasing of the supply voltage below a predetermined value, causing wear and deterioration of components such as the power transistor and the ignition coil due to the generation of heat by the undesired current supply upon increasing of the supply voltage above the predetermined value, and so on. As a result, in an attempt to overcome these deficiencies, it has been proposed to vary the "on" period of current flow through the ignition coil in accordance with variation in the supply voltage and thereby to suitably control the "on" period in consideration of the performance and the heat generation of the ignition system. Generally, the primary current flow in the ignition coil increases rapidly when the supply voltage becomes high, so that the operating level of the input transistor is made different from the ordinary value to delay the time of starting energization of the coil, whereas when the supply voltage is low the operating level of the input transistor is varied so as to start energization of the coil earlier than usual. For instance, when the supply voltage is high, the operating level of the input transistor is raised to decrease the "on" period of the coil, and when the supply voltage is low the operating level of the input transistor is lowered to increase the "on" period of the coil.

An example of this type of system is a contactless ignition system including a power transistor for controlling the flow of ignition coil primary current, an input transistor responsive to the ignition signals generated in synchronism with the engine rotation to control the turning on and off of the power transistor and a Zener diode for connecting the power source to the input transistor, whereby the Zener current flow varying in response to increase in the supply voltage is supplied to the input transistor so as to vary its operating level. This known system is disadvantageous from the manufacturing and performance points of view in that since the Zener diode is directly used as a control element for varying the operating level of the input transistor, non-uniform characteristics of Zener diodes will be caused in the case of mass-production systems of the same and the control will be made unstable against temperature changes.

A contactless ignition system of a different arrangement has been proposed in which a power transistor is controlled via an inverting transistor having its emitter connected to the emitter of an input transistor and to the ground via a common emitter resistor and its base connected to the collector of the input transistor, whereby the base current and the collector current of the inverting transistor are varied in response to variation of the supply voltage and the operating level of the input transistor is varied correspondingly. With this arrangement, as shown in FIG. 4 which will be described later, the operating level of the input transistor (and hence the "on" period of the ignition coil) varies substantially linearly with variation in the supply voltage (namely, the operating level varies proportionately with variation in the supply voltage and the "on" period linearly decreases or increases correspondingly, and this cannot be necessarily considered as the optimum control. Namely, the variation of the ignition coil primary current $I_1$ does not exhibit a linear characteristic with respect to variation in the supply voltage but it rather varies exponentially as will be explained later. Consequently, from the standpoint of maintaining the ignition energy at about the desired level and avoiding any undesired increase in the ignition energy, such a control of simply and linearly varying the "on" period of current flow does not conform with the exponential variation of the "on" period and therefore it cannot be considered as the optimum control.

Generally, the ignition coil primary current $I_1$ is given by the following equation $$I_1=(V_B-V_{CE})/R_1(1-e^{-(R_1/L_1)t})$$

Thus, the primary current $I_1$ does not vary linearly with the supply voltage $V_B$.

$V_B$=supply voltage, $V_{CE}$=power transistor saturation voltage, $R_1$=ignition coil primary resistance $L_1$=ignition coil primary inductance t="on" period for current flow $I_1$=ignition coil primary current It is therefore an object of the present invention to provide a supply-voltage-compensated contactless ignition system for internal combustion engines which overcomes the disadvantages of the above-mentioned systems.

In accordance with this invention, there is thus provided a supply-voltage-compensated contactless ignition system for an internal combustion engine comprising a high voltage generating ignition coil, switch means for controlling the flow of current from a DC power source to the coil, switch control means for controlling the switch means in response to synchronizing signals generated in synchronism with the rotation of the engine and compensating means for varying the operating level of the control means in accordance with variation of the supply voltage to compensate the operating level, wherein said compensating means is in the form of current shunting means responsive to a rise of the DC power supply voltage beyond a predetermined value to shunt an increased shunt current to the switch control means and thereby to vary the rate of change of the operating level.

In accordance with one aspect of this invention, the ignition system of an IC construction can be provided which is designed so that when the supply voltage varies, the operating level of the input transistor with respect to the ignition signal is not varied linearly but the rate of change of the operating level is increased in response to the rise of the supply voltage beyond a predetermined value.

In other words, there is provided such an ignition system exhibiting an operating level curve having two break points as shown in FIG. 4. Of course, it is possible to obtain any desired curve having any desired number of break points such as three or four by adding the required circuits. When this is possible, the desired operating level curve which matches any different AC signal waveform and any different ignition coil can be obtained freely making the ignition system stable in performance.

In accordance with another aspect of this invention, a contactless ignition system is provided which is constructed suitable for an IC construction such as a current mirror circuit which effectively utilizes the conventional supply voltage clamping means so as to vary the operating level of the input transistor, thus adapting the system for mass production and reducing the variations in characteristics which have been heretofore encountered among the mass-produced systems.

Further objects, features and advantages of the present invention will become apparent from the following description taken in conjunction with the accompanying drawings, in which.

Figure 1:
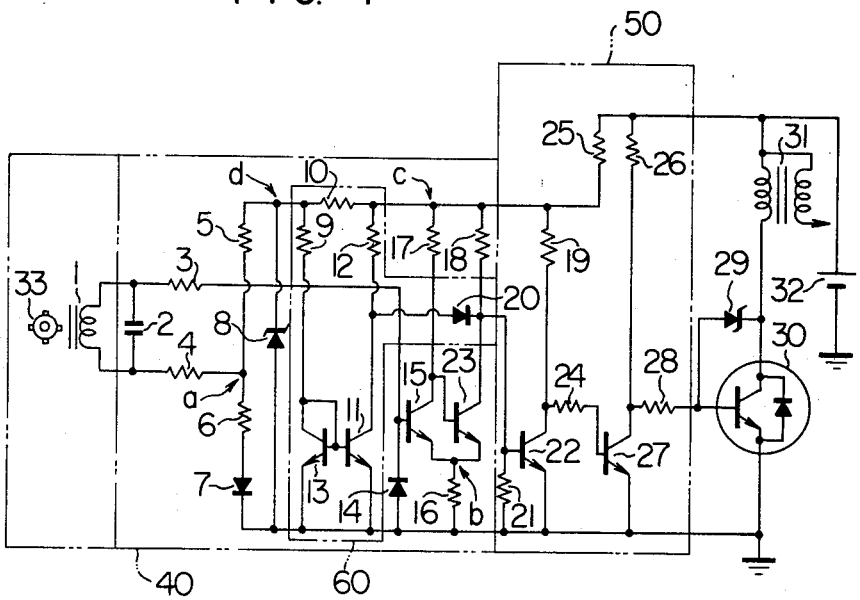
FIG. 1 is a circuit diagram showing an embodiment of a supply-voltage-compensated contactless ignition system for internal combustion engines in accordance with this invention.
Figure 2:
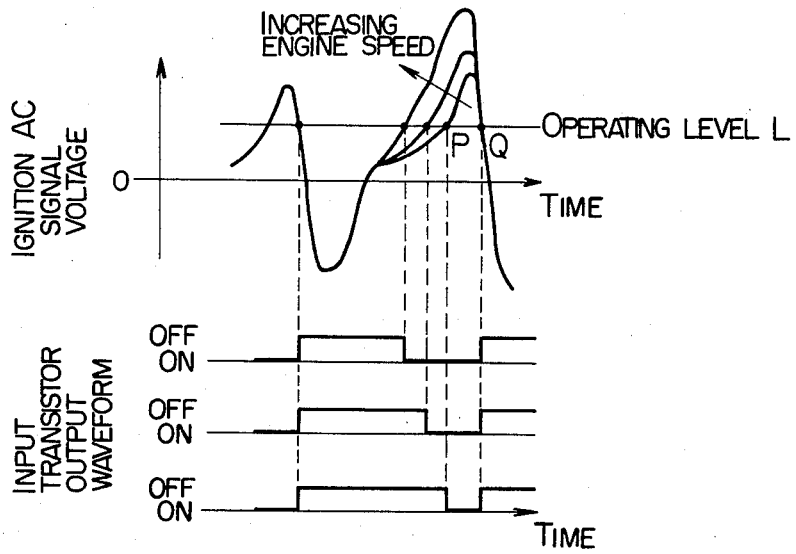
FIG. 2 is a diagram showing variations in the AC ignition signal waveform applied to the input transistor used in the circuitry of FIG. 1 and the ON and OFF conditions of the input transistor.

Referring to FIG. 1 illustrating an embodiment of the circuitry of an ignition system according to the present invention, numeral 1 designates an ignition signal generator coil incorporated for example in a distributor whereby an ignition AC signal voltage such as shown in FIG. 2 is generated by using a signal rotor 33 adapted for rotation in synchronism with the engine and the ignition signal voltage amplitude increases with increase in the engine speed as shown in the Figure. Numeral 40 designates a waveform reshaping circuit for converting the ignition signal voltage into a rectangular waveform, in which one end of a capacitor 2 connected in parallel with the coil 1 is connected via a resistor 3 to the base of an NPN input transistor 15 and the cathode of a diode 14 whose anode is connected to the ground, and a series combination of voltage dividing resistors 5 and 6 a diode 7 is connected in parallel with a voltage clamping Zener diode 8 which is connected in parallel with a battery power source 32 via resistors 10 and 25. The junction point a of the resistors 5 and 6 is connected to the other end of the capacitor 2 via a resistor 4, and the input transistor 15 has its collector connected via a resistor 17 to a feeding point c connected to the positive terminal of the power source 32 via the resistor 25 and also to the base of an inverting transistor 23 having its collector connected to the feed point c via a resistor 18. The transistors 15 and 23 have a common emitter electrode connection (indicated by a junction point b) to the ground by way of a resistor 16. The waveform reshaping circuit 40 further comprises a so-called current mirror circuit including NPN transistors 11 and 13 of substantially the same characteristics and the transistors 11 and 13 have a common base electrode connection to the collector of the transistor 13. The collector of the transistor 13 is also connected to a feeding point d via a resistor 9, and the collector of the transistor 11 is connected to the feeding point c via a resistor 12 having the same value as the resistor 9 and via a diode 20 to the collector of the inverting transistor 23 and to the base of an NPN transistor 22 provided in the following drive circuit 50. The feeding points c and d are connected to each other via the current sensing resistor 10 and the emitters of the transistors 11 and 13 are both connected to the ground to supply the emitter currents of the same magnitude. As will be described later, the resistors 12 and 9 for respectively first and second current paths for shunting the same amount of current flow under the normal supply voltage condition and the diode 20 forms a third current path for shunting an increased current upon increase in the supply voltage. In the connections described so far, with respect to the operating level of the input transistor 15 which is determined by the potentials at the junction points a and b, the input transistor 15 is turned on and off in response to the AC signal voltage shown in FIG. 2 and applied to its base and it generates at its collector the rectangular pulse which is shown in the Figure and which drives the base of the transistor 22 in the following drive circuit 50 through the inverting transistor 23. In the drive circuit 50, the collector of the transistor 22 is connected to the feeding point c via a resistor 19 and to the base of the following transistor 27 via a resistor 24. The collector of the transistor 27 is connected to the positive terminal of the power source 32 via a resistor 26 and to the base of a power transistor 30 via a resistor 28, and the emitters of the transistors 22 and 27 are connected to the ground. The primary winding of an ignition coil 31 is connected between the positive terminal of the power source 32 and the ground via the collector-emitter path of the power transistor 30, and a protective Zener diode 29 is connected across the collector and base of the power transistor 30. As a result, the waveform reshaping circuit 40 forms switch control means for controlling the power transistor 30 through the drive circuit 50, and the current mirror circuit 60 forms operating level compensating means.

Figure 3:
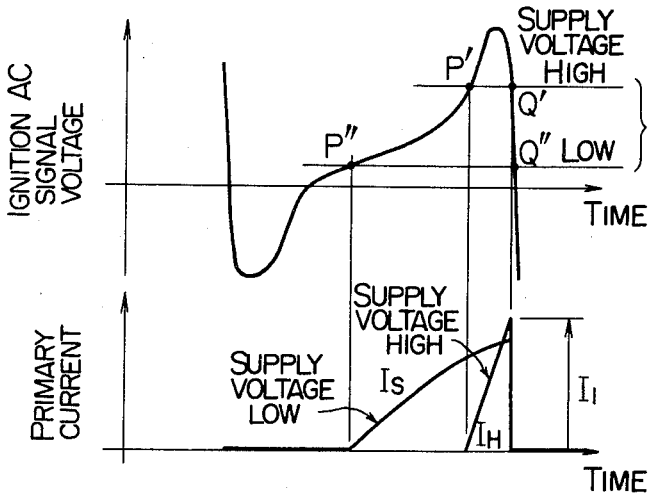
FIG. 3 is a diagram showing the relationship between the AC ignition signal waveform, the operating level of the input transistor, the power supply voltage and the ignition coil primary current.

With the arrangement described above, the power transistor 30 is turned on and off via the drive circuit 50 in response to the rectangular pulse output of FIG. 2 and current is supplied to the primary winding of the ignition coil 31 during the time corresponding to the ON output portion of the rectangular pulse. More specifically, the duration of current flow increases with an increase in the distance between points P and Q at which the operating level line L and the AC signal waveform cross each other in FIG. 2. With the operating level being fixed, if the duration of current flow is increased and if the supply voltage is increased, an undesired current will be supplied to the primary winding. FIG. 3 shows a method of compensating the operating level of the input transistor with respect to the AC signal waveform so as to overcome the above-mentioned deficiency. Thus, as shown in the Figure, when the supply voltage rises, the operating level of the input transistor is varied in a P'Q' direction to decrease the distance between the points P and Q (the operating level is raised) and the duration of current flow decreases. When the supply voltage drops, the operating level of the input transistor is varied in a P''Q'' direction to increase the distance PQ (the operating level is lowered) and the duration of current flow is increased. As a result, as shown by the graph of ignition coil primary current $I_1$, when the supply voltage becomes high, the current flow is corrected to one corresponding to the duration time P'Q' (the area enclosed by the curve $I_H$) in contrast to the current flow (the area enclosed by the curve $I_S$) corresponding to the duration time P''Q'' obtained when the supply voltage is low.

Figure 4:
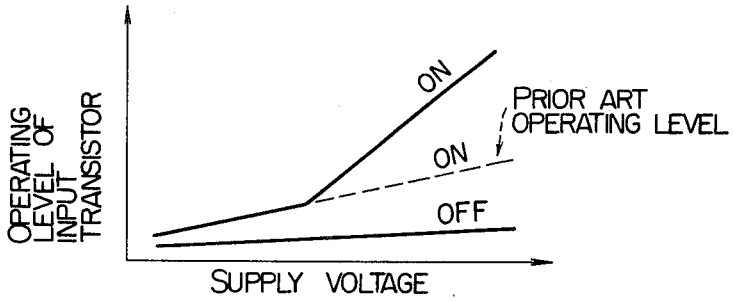
FIG. 4 is a diagram showing the relationship between the supply voltage and the operating level of the input transistor.

FIG. 4 shows the relationship between the variation of the supply voltage and the variation of the operating level of the input transistor in the case of the system according to this invention and an exemplary prior art system, respectively. While, in the prior art system, the operating level is varied linearly with variation of the supply voltage, the system of this invention is in the form of a contactless ignition system comprising an IC construction such that when the supply voltage rises beyond a predetermined value, the rate of change of the operating level is increased abruptly as shown in the Figure. The construction and operation which attain this feature will now be described in greater detail.

Referring again to FIG. 1, in response to the voltage of the AC voltage signal generated by the signal rotor 33 rotated in synchronism with the engine, the operating level of the input transistor 15 is determined by the potential at the junction point a of the voltage dividing resistors 5 and 6 and the potential at the point b. Considering first the case where the transistor 15 is off, the potential at the point b is determined by the collector current and the base current of the transistor 23. When the transistor 15 is turned on, the transistor 23 is turned off and consequently the potential at the point b is determined by the collector current and the base current of the transistor 15. As a result, the potential at the point b is varied in dependence on the collector current and the base current of the transistors 15 and 23, respectively. In this case, since the collector resistor of each of the transistors 15 and 23 is connected to the point c and since the potential at the point c varies substantially in proportion to variation in the voltage of the DC power source 32 such as the battery, the potential at the point b also varies in proportion to the supply voltage. This signifies that the operating level of the transistor 15 is increased with increase in the supply voltage and is decreased with decrease in the supply voltage as shown in FIG. 4 which was described previously.

Figure 5:
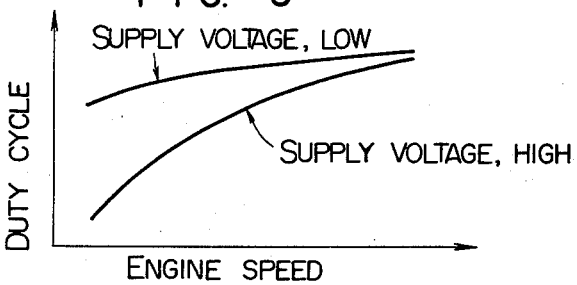
FIG. 5 is a diagram showing the relationship between the engine speed and the duty cycle of the input transistor.

Thus, since the operating level of the input transistor 15 varies in dependence on the supply voltage, in response to the ignition AC signal the operating level becomes as shown in the previously mentioned FIG. 3 and consequently the primary current in the ignition coil 31 which is switched on and off by the transistor 30, is controlled in such a manner that it has a waveform which rises rapidly in a short time when the supply voltage is high and which rises slowly in a long time when the supply voltage is low, thus attaining a predetermined peak value. As shown in FIG. 2, the ignition AC signal varies in a manner that it increase in amplitude and the rise time of its waveform is also increased with increase in the engine speed and thus the "on" period is increased. The ratio of this ON period to the total period of an ON-OFF cycle (hereinafter referred to as a duty cycle) is related to the engine speed as shown by the curves in FIG. 5. When the supply voltage is high, the duty cycle rapidly increases nonlinearly with respect to the fixed operating level of the input transistor.

Next, considering the primary current in the ignition coil at low engine speeds, the peak value of the primary current rapidly increases particularly when the supply voltage becomes high and consequently the operating level of the input transistor varying with the supply voltage must be made to vary rapidly so as to maintain the primary winding ignition energy at a constant value. On the other hand, at the start of the engine or the like the supply voltage decreases due to the supply of a large current to the starter motor. Thus, it is necessary to lower the operating level to satisfactorily increase the ON period of the primary current flow in the ignition coil. In view of these circumstances, it is an effective way to increase the rate of change of the input transistor operating level (ON level) as shown in FIG. 4 when the supply voltage is higher than a predetermined value. For this purpose, the circuit comprising the transistors 11 and 13, the resistors 9 and 12 and the diode 20 is included. This circuit is generally called a current mirror circuit and it is designed so that the emitter of the transistor 13 is supplied with a current of the same value as the emitter current of the transistor 11. While, this cannot of course be realized unless the transistors 11 and 13 have substantially the same characteristic values, the circuit is an effective circuit particularly in the case of IC circuitry.

Also, the collector resistor 9 of the transistor 13 and the collector resistor 12 of the transistor 11 are connected to the different supply lines at the ends of the resistor 10 whose resistance value is smaller than that of the resistor 5. As a result, if the potential at the point c is equal to the potential (at the point d) which is determined by the Zener diode 8, that is, when the supply voltage is low so that the voltage at the point d is lower than the Zener voltage, the emitter currents of the transistors 11 and 13 are supplied from the supply lines having substantially the same potential and no current flows to the diode 20. When the voltage of the power source 32 rises so that the voltage at the point d becomes higher than the Zener voltage, the voltage at the point d is clamped at the Zener voltage and thus the voltage at the point c becomes higher than the voltage at the point d. When this occures, since the emitter currents of the transistors 11 and 13 are the same, a portion of the collector current of the transistor 11 flows as the collector current of the transistor 23 via the diode 20. This increases the potential at the point b and the operating level of the transistor 15 is raised further. Thus, there results a curve such that the operating level rises sharply in response to the supply voltage higher than a certain value and the object is attained.

While, in the embodiment described above, the single current mirror circuit is used, it is possible to connect for example two or three units of the current mirror circuit such that each of the circuits sets any desired rate of change of the operating level of the input transistor in response to a preset voltage of the voltage regulating circuit.

In accordance with the present invention there is thus provided a supply-voltage-compensated contactless ignition system for internal combustion engines which comprises an IC construction capable of suitably automatically controlling the ignition coil primary current in response to the variation of supply voltage, thus preventing variations in quality among different systems and instability against temperature changes which have heretofore been encountered in the case of mass production.

Further, the operating level of the ignition system can be determined as desired in accordance with the supply voltage in response to the factors including the power transistor current capacity, the ignition signal waveform and the primary interrupting current value of the ignition coil. This makes it possible to suitably control the "on" period of current flow of the power transistor.

Further, since the operating level of the input transistor is varied by utilizing the existing voltage clamping Zener diode which is advantageously included in the waveform reshaping circuit, the diode can be used to attain two purposes and there is no need to additionally provide such a diode. Further, since the Zener current of the Zener diode is not used directly but used indirectly via the current sensing resistor for varying the operating level of the input transistor, it is possible to overcome the problems of the variations in characteristics among different Zener diodes and unstable operation due to temperature changes.

While the invention has been described with reference to a preferred embodiment thereof, the embodiment is made for illustrative purposes only and not as a limitation on the scope of the invention and those skilled in the art may make various other changes and modifications without departing from the spirit and scope of the invention. Also, it should be apparent that the invention is a great contribution to the industrial field to which it pertains.

What is claimed is:

1. A contactless ignition system for internal combustion engines comprising: a DC power source for supplying a DC voltage;

an ignition coil;

a signal generator for generating a synchronizing signal in synchronism with the rotation of an engine;

switch means for controlling a current flowing to said coil from said DC power source;

control means for controlling said switch means in response to said synchronizing signal, said control means including:

input transistor means, compensation means for changing an operating level of said input transistor means in response to change of the DC voltage of said power source, said compensation means including a current mirror circuit for changing said operating level at a first rate of change with change of said DC voltage not larger than a predetermined value and changing said operating level at a second rate of change larger than said first rate of change with change of said DC voltage not smaller than said predetermined value.

2. A system according to claim 1, wherein said current mirror circuit includes first and second current shunt paths for respectively passing currents of first and second magnitudes when said source voltage is normal, said first shunt path shunting said first current increased over said second current in response to said source voltage rise beyond said predetermined value, and a third current shunt path for shunting said increased first current to said switch control means.

3. A system according to claim 1, wherein said current mirror circuit includes first and second current paths connected in parallel with said switch control means for shunting currents of substantially the same magnitude when said source voltage is normal and for increasing one of said currents in response to a rise of said source voltage beyond said predetermined value, and a third current path for shunting said increased current to said switch control means.

4. A system according to any one of claims 1 to 3, wherein said compensating means includes voltage clamping means connected in parallel with said DC power source via said current mirror circuit and said switch control means.

5. A system according to any one of claims 1 to 3, wherein said current mirror circuit includes first and second transistors having substantially the same operating characteristics and having the bases thereof connected to each other, said first transistor having a collector directly connected to its base, and said second transistor having a collector connected through a diode to said input transistor means.

6. A system according to claim 1, wherein said current mirror circuit includes first and second transistors connected in parallel with said switch control means and having substantially the same operating characteristics to conduct currents of substantially the same magnitude when said source voltage is normal, said first transistor being connected to said second transistor to form a current path for passing a current increased over the current flowing through said second transistor in response to said source voltage rise beyond said predetermined value, and means for shunting said increased current to said switch control means, and wherein said compensating means includes voltage clamping means connected in parallel with said power source via said current mirror circuit and said switch control means.

7. A system according to claim 1, wherein said current mirror circuit includes a current sensing resistor connected to said DC power source, a first transistor having its collector connected to a power source positive side terminal of said resistor and its emitter connected to a negative terminal of said power source, a second transistor having its collector connected to a power source negative side terminal of said resistor, its emitter connected to said power source negative terminal and its base connected to the collector thereof and to a base of said first transistor, and diode means connecting the collector of said first transistor to said switch control means.

8. A system according to any one of claims 1 to 3, wherein said input transistor means includes an input transistor connected in parallel with said DC power source via a collector resistor and an emitter resistor, and an inverting transistor having its emitter and base respectively connected to an emitter and a collector of said input transistor and its collector connected to said DC power source via another collector resistor so as to control said switch means.

9. A system according to claim 1, further comprising a voltage clamping Zener diode connected in parallel with said DC power source via said current mirror circuit, and wherein said current mirror circuit includes a current sensing resistor connected to said DC power source, first and second transistors having substantially the same operating characteristics, said first transistor having its collector connected to a power source positive side terminal of said sensing resistor via a first resistor and its emitter connected to a negative terminal of said power source, said second transistor having its collector connected to a power source negative side terminal of said sensing resistor via a second resistor, its emitter connected to said power source negative terminal and its base connected to the collector thereof and to a base of said first transistor, and diode means connecting the collector of said first transistor to said switch control means.

10. A system according to claim 9, wherein said input transistor means includes an input transistor connected in parallel with said DC power source via a collector resistor and an emitter resistor, and an inverting transistor having its emitter and base respectively connected to an emitter and a collector of said input transistor and its collector connected to said DC power source via another collector resistor so as to control said switch means, and wherein the collector of said first transistor is connected to the collector of said inverting transistor via said diode means whereby an operating level of said input transistor is changed abruptly in response to said source voltage rise beyond said predetermined value.

11. A system according to claim 1; wherein said switch means comprises a power transistor; said switch control means includes (i) a parallel circuit of voltage clamping means and first and second voltage dividing resistors connected in parallel with said power source, said input transistor means including an input transistor connected in parallel with said power source via a collector resistor and an emitter resistor and an inverting transistor having its emitter and base respectively connected to an emitter and a collector of said input transistor and its collector connected to said power source via another collector resistor to invert the operation of said input transistor, (ii) a current sensing resistor connected between the collector resistor of said input transistor and said voltage clamping means, said current mirror circuit including first and second transistors connected in parallel via said sensing resistor to shunt substantially the same amount of currents when said source voltage is normal, said first transistor being connected to said second transistor to form a current path for shunting a shunt current increased over the shunt current flowing through said second transistor in response to said source voltage rise beyond said predetermined value, diode means for shunting said increased shunt current to the collector of said inverting transistor to vary an operating level of said input transistor, and (iii) driving transistor means responsive to said inverting transistor to drive said power transistor; and said signal generator having a first output terminal connected to the junction point of said first and second voltage dividing resistors and a second output terminal connected to the base of said input transistor for generating said synchronizing signal to control the operation of said input transistor.

12. A contactless ignition system for internal combustion engines comprising:

a storage battery;

an ignition coil connected to be energized by said storage battery and generate a spark voltage supplied to an internal combustion engine upon deenergization thereof;

a power transistor connected in series with said ignition coil for energizing and deenergizing said ignition coil in response to the conduction and nonconduction thereof, respectively;

a signal generator associated with said internal combustion engine for generating an alternating current signal in timed relation of said internal combustion engine;

control transistor means connected between said signal generator and said power transistor for rendering said power transistor conductive and nonconductive when the magnitude of said alternating current signal is above and below a threshold value, respectively;

a series circuit of a resistor and a Zener diode connected to said storage battery; and a current mirror circuit connected to said series circuit for increasing said threshold value of said control transistor means in accordance with the increase in the voltage of said storage battery, the threshold increasing rate relative to the voltage of said storage battery being switched to a larger value when said Zener diode is conductive.

* * * * *